US011864655B2

(12) United States Patent
Li

(10) Patent No.: US 11,864,655 B2
(45) Date of Patent: Jan. 9, 2024

(54) SHELVING BOARD AND SHELVING ASSEMBLY COMPRISING THE SAME

(71) Applicant: HANGZHOU GREAT STAR INDUSTRIAL CO., LTD., Hangzhou (CN)

(72) Inventor: Yueming Li, Hangzhou (CN)

(73) Assignee: HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 124 days.

(21) Appl. No.: 17/295,785

(22) PCT Filed: Apr. 1, 2021

(86) PCT No.: PCT/CN2021/084830
§ 371 (c)(1),
(2) Date: May 20, 2021

(87) PCT Pub. No.: WO2022/165970
PCT Pub. Date: Aug. 11, 2022

(65) Prior Publication Data

US 2022/0248850 A1 Aug. 11, 2022

(30) Foreign Application Priority Data

Feb. 5, 2021 (CN) ..... 202110163507.9

(51) Int. Cl.
*A47B 96/06* (2006.01)
*A47B 96/02* (2006.01)

(52) U.S. Cl.
CPC ..... *A47B 96/066* (2013.01); *A47B 96/021* (2013.01); *A47B 96/028* (2013.01); *A47B 96/061* (2013.01)

(58) Field of Classification Search
CPC ... A47B 96/066; A47B 96/028; A47B 96/061; A47B 96/021; F16B 11/006; F16B 1/00; F16B 2/08; F16B 2001/0028
See application file for complete search history.

(56) References Cited

U.S. PATENT DOCUMENTS 118,433 A * 8/1871 Chesley ..... A47B 96/061 108/152
3,698,329 A * 10/1972 Diamond ..... A47B 96/06 108/42

(Continued)

FOREIGN PATENT DOCUMENTS

CN 2626331 Y 7/2004
CN 104305735 A 1/2015

(Continued)

*Primary Examiner* — Ko H Chan
(74) *Attorney, Agent, or Firm* — Fitch, Even, Tabin & Flannery, LLP

(57) ABSTRACT

A shelving board is used in conjunction with a bracket or rack in a shelving system, for carrying items. The shelving board comprises a board body and a connecting piece. The board body may be a hollow structure or a recessed-and-raised structure, to reduce the material consumption and reduce the cost without affecting the strength. The connecting piece is used to hinder a relative movement between the board body and the rack or between the board body and the bracket, so as to improve the stability of the shelving board. The shelving board may be made by an extrusion process and cut into any length as required. Shelving boards may also be made into prefabricated pieces by an injection molding process, which are spliced into a desired length by means of splicing portions processed on the shelving boards.

26 Claims, 7 Drawing Sheets

(56) References Cited

U.S. PATENT DOCUMENTS 4,098,480 A * 7/1978 Neumann ..... A47B 96/028 248/242
4,478,337 A * 10/1984 Flum ..... A47B 45/00 220/8
4,500,146 A * 2/1985 Peterson ..... A47B 45/00 211/175
4,696,406 A * 9/1987 Karashima ..... A47B 96/021 403/345
4,890,746 A * 1/1990 Trulaske, Sr. ..... A47F 5/01 211/153
5,228,581 A * 7/1993 Palladino ..... F25D 25/02 108/90
5,297,486 A * 3/1994 Herrmann ..... A47B 96/062 248/250
5,346,077 A * 9/1994 Randall ..... A47B 96/028 211/90.03
5,351,842 A * 10/1994 Remmers ..... A47B 96/028 108/29
5,538,147 A * 7/1996 Fucci ..... A47F 5/01 108/90
5,553,824 A * 9/1996 Dutra, Jr. ..... G06F 1/1632 248/924
5,597,077 A * 1/1997 Hartmann ..... A47F 5/0056 211/183
5,893,470 A * 4/1999 Peggs ..... A47F 3/0486 211/90.01
5,899,147 A * 5/1999 Clayton ..... A47B 96/028 108/42
6,134,854 A * 10/2000 Stanchfield ..... E04F 11/16 52/480
6,332,548 B1 * 12/2001 West ..... A47B 61/02 211/175
6,401,945 B1 * 6/2002 Gawel ..... A47F 5/0043 211/183
6,725,785 B2 * 4/2004 Wang ..... A47B 13/08 108/90
7,810,440 B2 * 10/2010 Ward ..... A47F 5/01 108/90
8,408,404 B2 * 4/2013 Miller ..... B25H 1/00 211/90.01
8,511,488 B2 * 8/2013 Poisson ..... A47B 96/021 211/183
9,788,667 B2 * 10/2017 Williams ..... F16B 2/065
2001/0045402 A1 * 11/2001 Hawley ..... A47B 96/02 211/183
2008/0209839 A1 * 9/2008 Amato ..... E04F 19/061 52/309.1
2009/0001037 A1 * 1/2009 Wilcock ..... A47B 96/02 211/119.003
2009/0266022 A1 * 10/2009 Lin ..... E04F 15/10 52/506.1
2010/0252521 A1 * 10/2010 Chen ..... A47B 91/00 211/208
2011/0204005 A1 * 8/2011 Freitas ..... A47B 81/00 211/4
2018/0184804 A1 7/2018 Green

FOREIGN PATENT DOCUMENTS

CN 105443521 A 3/2016
CN 107420401 A 12/2017
CN 210902348 U 7/2020
CN 211795067 U 10/2020
CN 211961257 U 11/2020
CN 212213370 U 12/2020
FR 2082524 A5 12/1971
JP 2000287768 A * 10/2000
JP 2005318941 A * 11/2005

* cited by examiner

SHELVING BOARD AND SHELVING ASSEMBLY COMPRISING THE SAME

CROSS-REFERENCE TO RELATED APPLICATIONS

This application is a U.S. national phase application of International Application No. PCT/CN2021/084830, filed Apr. 1, 2021, which claims priority to Chinese Patent Application No. 202110163507.9, filed Feb. 5, 2021.

FIELD OF THE INVENTION

The present invention relates to the field of warehousing equipment, and in particular to a shelving board and a shelving assembly comprising the shelving board.

DESCRIPTION OF THE PRIOR ART

Shelves are commonly used equipment in daily life. Household shelves are usually used to place clothes, daily necessities, etc., and commercial shelves are usually used to place commodities and products. Among them, shelves installed on vertical surfaces are widely used in supermarkets and shopping malls because of their small footprints. A shelf of this kind usually has a plurality of brackets fixedly installed on a vertical wall surface or a board surface, and then a rack is placed horizontally on the brackets to form a shelf. The rack has a grid-like structure, which is composed of a plurality of transverse metal wires provided in parallel and a plurality of longitudinal metal wires provided in parallel interwoven. The spacing between adjacent longitudinal metal wires is less than the spacing between adjacent transverse metal wires. A usual placement method is that the longitudinal metal wires are above the transverse metal wires.

Due to the grid-like structure of the rack, there are gaps between adjacent transverse metal wires and adjacent longitudinal metal wires, so that small-volume items are not suitable for being placed on the rack. Or, even if the volume of an item is not so small that it falls through the gaps between the metal wires, there may be some small parts on the item stuck in the gaps between the metal wires. In addition, the upper surface of the rack is inevitably uneven somewhere, so that some items that have requirements for the placement angle are not suitable for being placed directly on the rack. Therefore, a shelving board is usually provided on the rack to solve the problem of unevenness of the rack.

The common shelving board in the prior art is usually rectangular and made of plastic or metal. Its size is similar to the size of the rack, or slightly greater than the size of the rack. However, the commonly used solid shelving board has the problem that it is difficult to balance strength, cost, and weight. If the thickness of the shelving board is increased in order to increase the strength, it will increase the cost and at the same time increase the self-weight of the shelving board, which will further affect the carrying capacity of the entire shelf. If the thickness of the shelving board is reduced in order to reduce cost and self-weight, the strength of the shelving board will be insufficient, so that it is prone to be deformed and warped.

In the prior art, the shelving board is directly placed on the rack, so the shelving board is easy to slide in a horizontal direction relative to the rack, which causes the shelving system to be unstable.

In some prior art, the rack needs to be placed in a tilted manner. Therefore, a method of placing the transverse metal wires on the top and the longitudinal metal wires on the bottom is adopted, that is, a commonly used rack is turned upside down. Because the number of the transverse metal wires is significantly less than that of the longitudinal metal wires, and the diameter of the transverse metal wires is significantly greater than that of the longitudinal metal wires, the surface of the rack is even more uneven. The shelving board is in direct contact with the transverse metal wires, and the force-receiving area is small such that the generated pressure is large, making the strength of the shelving board challenged. Moreover, since the shelving board is placed in a tilted manner along with the rack, it faces a greater risk of sliding.

In addition, the shelving board in the prior art is usually prefabricated, which is suitable for a rack of a certain size and model. Difficulties arise when the size of the rack changes, or when it is used to adapt to racks of other sizes. Equipping different shelving board molds for all sizes of grid-like brackets will cause a lot of cost waste.

The strength of the shelving board and the stability of the shelving system are both important indicators of the shelving system. Cost is one of the key factors that have to be considered in industrial production. Therefore, those skilled in the art are motivated to develop a shelving board to solve the technical problems existing in the prior art.

SUMMARY OF THE INVENTION

In order to overcome the defects in the prior art, the present application provides a shelving board, comprising a board body and a connecting piece, wherein the connecting piece is connected to the board body, and the connecting piece is configured to be connected to a bracket or a rack so as to hinder a relative movement of the board body relative to the bracket.

In some embodiments, optionally, the board body comprises a first surface, and the connecting piece is detachably connected to the first surface of the board body.

In some embodiments, optionally, a matching groove is provided on the first surface, the connecting piece comprises a matching portion, and the matching portion is detachably connected to the matching groove to realize a connection between the connecting piece and the board body.

In some embodiments, optionally, the width of a groove bottom of the matching groove is greater than the width of a notch of the matching groove.

In some embodiments, optionally, the matching portion has a first side surface, the maximum width of the first side surface is less than or equal to the width of the groove bottom, and the maximum width of the first side surface is greater than the width of the notch.

In some embodiments, optionally, the matching portion has a second side surface, and the maximum width of the second side surface is less than the width of the notch.

In some embodiments, optionally, the connecting piece has a first posture, and in the first posture, the first side surface is set to be perpendicular to the length direction of the matching groove, such that the matching portion is engaged into the matching groove.

In some embodiments, optionally, the connecting piece has a second posture, and in the second posture, the second side surface is set to be perpendicular to the length direction of the matching groove, such that the matching portion can enter or exit the matching groove.

In some embodiments, optionally, the connecting piece is fixedly connected to the first surface of the board body.

In some embodiments, optionally, the connecting piece comprises a position-limiting protrusion, and the position-limiting protrusion is configured to receive a transverse metal wire.

In some embodiments, optionally, the position-limiting protrusion comprises a first petal, and the first petal is configured to impart a force on the transverse metal wire toward a head.

In some embodiments, optionally, the position-limiting protrusion comprises a second petal, and the second petal is configured to impart a force on the transverse metal wire toward a tail.

In some embodiments, optionally, the first petal and the second petal are arc-shaped, and the first petal and the second petal are oppositely provided, such that a receiving space is formed between the first petal and the second petal.

In some embodiments, optionally, the spacing between an end portion of the first petal and an end portion of the second petal is less than the diameter of the transverse metal wire.

In some embodiments, optionally, the connecting piece comprises a head hook portion, and the head hook portion is a semi-enclosed structure extending from a head of the board body.

In some embodiments, optionally, the head hook portion comprises a first bent portion and a first baffle, and the first baffle is connected to the board body through the first bent portion.

In some embodiments, optionally, the head hook portion comprises a second bent portion and a second baffle, and the second baffle is connected to the first bent portion through the second bent portion.

In some embodiments, optionally, the connecting piece comprises a position-limiting hook, and the position-limiting hook is provided at a tail of the board body.

In some embodiments, optionally, the position-limiting hook is configured to be engaged with a raised rib on the bracket.

In some embodiments, optionally, the position-limiting hook is configured to be connected to a transverse metal wire on the rack.

In some embodiments, optionally, the board body comprises a second surface, and the second surface is configured to have a recessed-and-raised structure.

In some embodiments, optionally, the recessed-and-raised structure comprises recessed grooves and raised bands, and the recessed grooves and the raised bands are alternately provided.

In some embodiments, optionally, the shelving board comprises a plurality of the recessed grooves, and the plurality of recessed grooves are provided parallel to each other.

In some embodiments, optionally, a hollow channel is provided in the interior of the board body.

In some embodiments, optionally, the shelving board comprises a plurality of the hollow channels, and the plurality of hollow channels are provided parallel to each other.

In some embodiments, optionally, the board body comprises a splicing protrusion, and the splicing protrusion is provided at an end of the board body.

In some embodiments, optionally, the board body comprises a splicing recess, and the splicing recess is provided at an end of the board body away from the splicing protrusion.

In some embodiments, optionally, the splicing protrusion and the splicing recess have matching shapes and sizes.

Another object of the present application is to provide a shelving assembly, comprising at least two shelving boards, wherein the at least two shelving boards are spliced by means of a splicing mechanism.

In some embodiments, optionally, the splicing mechanism comprises a splicing protrusion, and the splicing protrusion is provided at an end of the shelving board.

In some embodiments, optionally, the splicing mechanism comprises a splicing recess, and the splicing recess is provided at an end of the shelving board away from the splicing protrusion.

In some embodiments, optionally, the splicing protrusion and the splicing recess have matching shapes and sizes.

In some embodiments, optionally, the splicing protrusion and the splicing recess are engaged with each other to realize splicing of the shelving boards.

Another object of the present application is to provide a shelving assembly comprising a shelving board and a rack, wherein the shelving board is connected to the rack.

In some embodiments, optionally, the shelving board comprises a connecting piece, and the shelving board is connected to the rack through the connecting piece.

In some embodiments, optionally, the rack comprises a transverse metal wire, and the connecting piece is connected to the transverse metal wire to realize a connection between the shelving board and the rack.

In some embodiments, optionally, the rack comprises a longitudinal metal wire, and the connecting piece is connected to the longitudinal metal wire to realize a connection between the shelving board and the rack.

In some embodiments, optionally, the shelving assembly at least comprises two longitudinal metal wires provided in parallel, and the connecting piece is provided between the two longitudinal metal wires.

In some embodiments, optionally, the shelving board comprises a board body, and the connecting piece is integrally formed with the board body.

In some embodiments, optionally, the shelving board comprises a board body, and the connecting piece is detachably connected to the board body.

Another object of the present application is to provide a shelving assembly, comprising a shelving board and a bracket, wherein the shelving board is connected to the bracket.

In some embodiments, optionally, the shelving board comprises a connecting piece, and the shelving board is connected to the bracket through the connecting piece.

In some embodiments, optionally, the connecting piece comprises a position-limiting hook, the position-limiting hook is provided at a tail of the board body, and the position-limiting hook is connected to a raised rib of the bracket.

In some embodiments, optionally, the position-limiting hook is a part extending from the tail of the board body.

In some embodiments, optionally, the position-limiting hook is fixedly connected to the board body.

Another object of the present application is to provide a shelving assembly comprising a shelving board, a rack, and a bracket, wherein the rack is connected to the bracket, and the shelving board is connected to the bracket.

In some embodiments, optionally, the shelving board comprises a connecting piece, and the connecting piece is connected to the bracket to realize a connection between the shelving board and the bracket.

In some embodiments, optionally, the connecting piece comprises a position-limiting hook, the position-limiting hook is provided at a tail of the board body, and the position-limiting hook is connected to a raised rib of the bracket.

In some embodiments, optionally, the position-limiting hook is a part extending from the tail of the board body.

In some embodiments, optionally, the position-limiting hook is fixedly connected to the board body.

In some embodiments, optionally, the connecting piece is connected to the rack to realize a connection between the shelving board and the bracket.

In some embodiments, optionally, the rack comprises a transverse metal wire, and the connecting piece is connected to the transverse metal wire to realize a connection between the shelving board and the rack.

In some embodiments, optionally, the rack comprises a longitudinal metal wire, and the connecting piece is connected to the longitudinal metal wire to realize a connection between the shelving board and the rack.

Another object of the present application is to provide a shelving assembly, comprising a shelving board, a rack, a bracket, a vertical beam, and a horizontal beam, wherein the horizontal beam is configured to be connected to a vertical surface, the vertical beam is connected to the horizontal beam, the bracket is connected to the vertical beam, the rack is connected to the bracket, and the shelving board is connected to the bracket.

In some embodiments, optionally, the shelving board comprises a connecting piece, and the connecting piece is connected to the bracket to realize a connection between the shelving board and the bracket.

In some embodiments, optionally, the connecting piece comprises a position-limiting hook, the position-limiting hook is provided at a tail of the board body, and the position-limiting hook is connected to a raised rib of the bracket.

In some embodiments, optionally, the position-limiting hook is a part extending from the tail of the board body.

In some embodiments, optionally, the position-limiting hook is fixedly connected to the board body.

In some embodiments, optionally, the connecting piece is connected to the rack to realize a connection between the shelving board and the bracket.

In some embodiments, optionally, the rack comprises a transverse metal wire, and the connecting piece is connected to the transverse metal wire to realize a connection between the shelving board and the rack.

In some embodiments, optionally, the rack comprises a longitudinal metal wire, and the connecting piece is connected to the longitudinal metal wire to realize a connection between the shelving board and the rack.

Compared with the prior art, the beneficial effects of the present application are as follows:

The present application provides a connecting piece for hindering relative sliding between a shelving board and a bracket. The connecting piece may be fixedly connected to a board body, or may be detachably connected to the board body. The stability of the shelving board can be increased, thereby improving the stability and carrying capacity of the entire shelving system.

The board body of the shelving board provided in the present application adopts a grooved surface or a grid-like hollow structure, which reduces the material consumption and reduces the production cost without affecting the strength and carrying capacity of the shelving board.

The shelving board provided in the present application can be made by an extrusion process, and can be cut into any length as needed so as to be suitable for racks of various sizes.

The shelving board provided in the present application can be made into a prefabricated piece with a connecting portion by an injection molding process, which is convenient for storage and transportation, and at the same time also convenient for processing of a connecting piece on the surface of the board body. During installation, according to a need, a plurality of prefabricated pieces of the shelving boards are connected and spliced in sequence to fit racks of various sizes.

When the shelving board provided in the present application is used in conjunction with a rack with an uneven surface, a technical solution of an avoiding groove combined with a position-limiting piece can be used to reduce the strength requirement for the shelving board, reduce the material consumption, and enhance the stability at the same time.

1—horizontal beam, 2—vertical beam, 3—bracket, 31—raised rib, 32—bracket connecting portion, 4—rack, 41—longitudinal metal wire, 42—transverse metal wire, 43—head extension, 5—shelving board, 501—head hook portion, 502—board body, 51—recessed groove, 52—raised band, 53—matching groove, 531—notch, 532—groove bottom, 54—bent portion, 55—first baffle, 56—bent portion, 57—second baffle, 58—bent portion, 59—hollow channel, 510—avoiding groove, 511—splicing protrusion, 512—splicing recess, 6—position-limiting knob, 61—position-limiting matching portion, 63—first side surface, 64—rotating portion, 65—second side surface, 7—position-limiting protrusion, 71—first petal, 72—second petal, 73—receiving space, 74—base, 8—position-limiting hook, 81—hook end, 82—hook bend, 83—hook base.

DETAILED DESCRIPTION OF THE PREFERRED EMBODIMENTS

Hereinafter, preferred embodiments of the present application will be introduced with reference to the drawings attached to the specification, so that the technical content will be clearer and easier to understand. The present application can be embodied in many different forms of embodiments, and the scope of protection of the present application is not limited to the embodiments mentioned herein. A shelving system is fixed on a vertical surface, so a shelving board is placed horizontally or at a certain angle with a horizontal plane. In the horizontal plane, a direction perpendicular to the vertical plane is called "longitudinal direction"; and in the horizontal plane, a direction parallel to the vertical plane is called "transverse direction" or "length direction". For brackets, racks and shelving boards, ends close to the vertical beam are called the "tails", and ends far away from the vertical beam are called the "heads".

Embodiment 1

Figure 1:
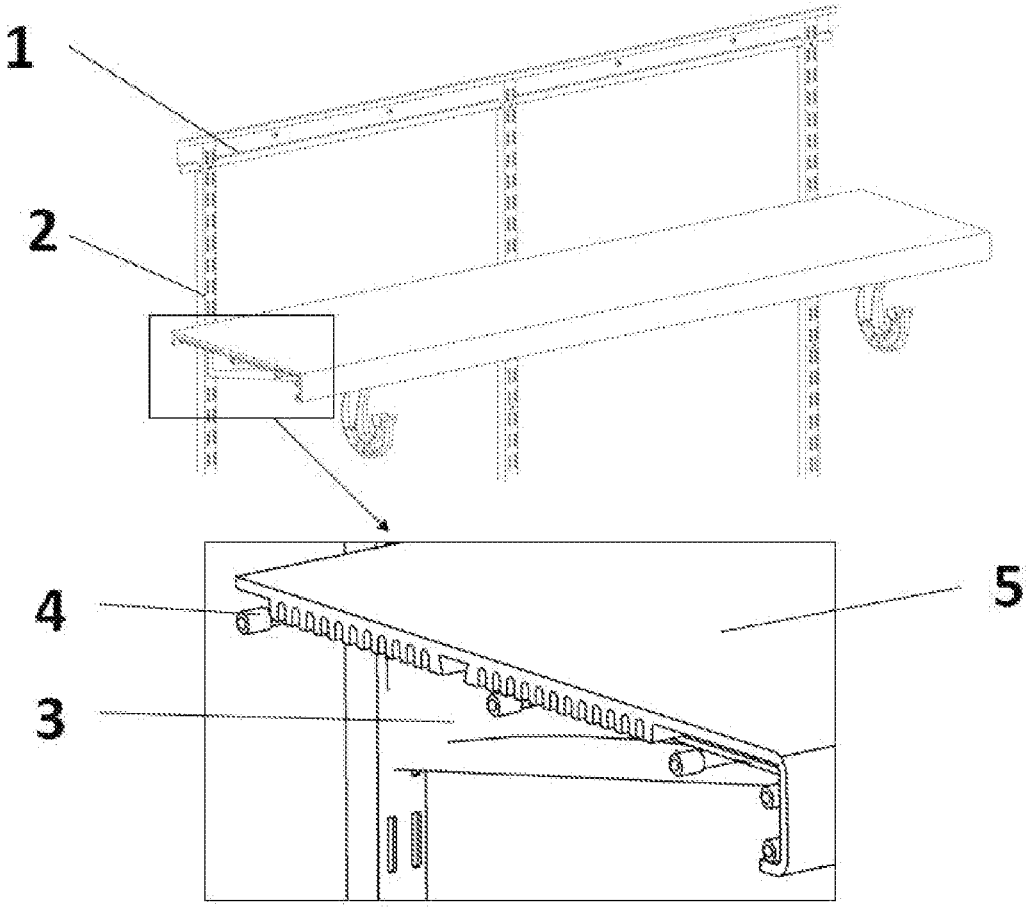
FIG. 1 is a schematic view of an overall structure in Embodiment 1 of the present application.
Figure 2:
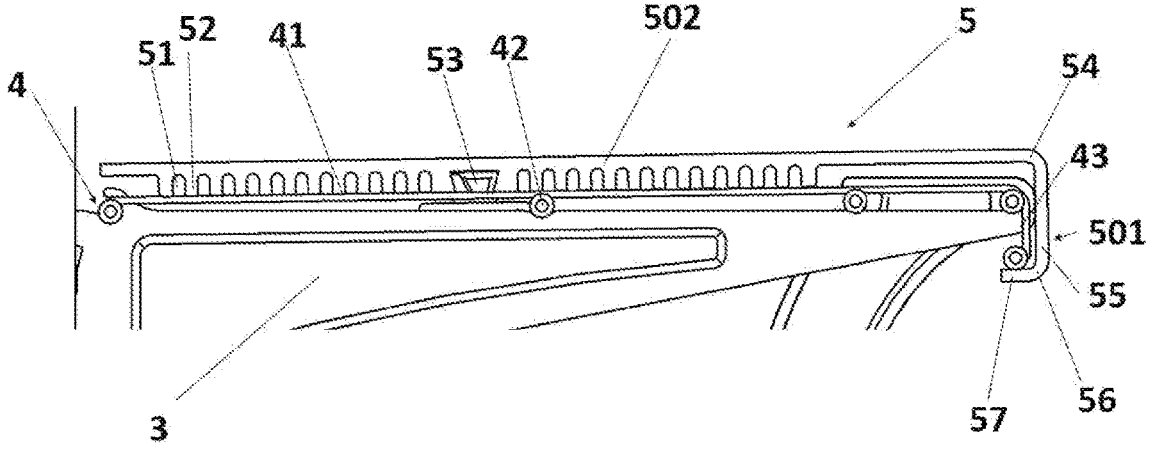
FIG. 2 is a schematic side cross-sectional view of Embodiment 1 of the present application.

The structure in this embodiment is shown in FIGS. 1-2. FIG. 1 shows a shelving assembly for which this embodiment is applicable and an partial area enlarged schematic view. A horizontal beam 1 is fixedly connected to a vertical surface, which is usually a vertical wall surface or board surface. A vertical beam 2 is fixedly connected to the horizontal beam 1 in a direction perpendicular to the horizontal beam 1, and the vertical beam 2 is also fixed on the vertical surface. A bracket 3 is set to be detachably connected to the vertical beam 2 or directly fixedly connected to the vertical surface. The side cross-section of the bracket 3 is substantially triangular, and its upper edge is horizontally provided. A rack 4 is provided on the upper edge of the bracket 3, a shelving board 5 is provided on the rack 4, and the shelving board 5 is connected to the rack 4 to realize connection to the bracket 3.

As shown in FIG. 2, a board body 502 of the shelving board 5 is made of a material with certain elasticity, such as plastic or metal, and is substantially sheet-like. One surface of the sheet-like board body 502 is in contact with a surface of the rack 4. Specifically, in this embodiment, since longitudinal metal wires 41 of the rack 4 is provided above transverse metal wires 42, the lower surface of the board body 502 is in contact with the longitudinal metal wires 41. The surface of the board body 502 away from the rack 4, that is, the upper surface in this embodiment, is set to be flat for carrying items, and the lower surface of the board body 502 is set to have a recessed-and-raised structure, so as to reduce the material consumption and to reduce the production cost without reducing the strength of the shelving board 5. In this embodiment, a plurality of recessed grooves 51 are provided on the lower surface of the board body 502, and these recessed grooves 51 are all transversely provided, are parallel to each other, and cross the lower surface of the entire board body 502. A raised band 52 is formed between every two adjacent recessed grooves 51, such that the recessed grooves 51 and the raised bands 52 are alternately distributed. Since each recessed groove 51 is transversely provided, the formed raised bands 52 also transversely cross the lower surface of the board body 502. In this embodiment, the widths and depths of the plurality of recessed grooves 51 are all the same. Spacings between every two adjacent recessed grooves 51 are also the same, such that the widths of the plurality of raised bands 52 formed are the same. In addition, the heights of the raised bands 52 are all the same, such that the lower surface of the board body 502 remains flat as a whole. In other similar embodiments, the widths and depths of the plurality of recessed grooves 51 may be different, but it should still be ensured that the lower surface of the board body 502 matches the shape of the rack 4 to form a stable and reliable contact.

In this embodiment, the head of the rack 4 has a head extension 43. The head extension 43 is an extension part bent downward relative to the rack 4. A first baffle 55 is provided at the head of the shelving board 5, and the first baffle 55 is connected to the shelving board 5 through a bent portion 54, such that a certain angle is formed between the first baffle 55 and the shelving board 5. In this embodiment, preferably, the angle is 90 degrees. A second baffle 57 is also provided, and the second baffle 57 is connected to the first baffle through a bent portion 56, such that a certain angle is formed between the second baffle 57 and the first baffle 55. In this embodiment, preferably, the angle is 90 degrees. The first baffle 55 and the second baffle 57 are connected by the bent portion 54 and the bent portion 56 to jointly form a head hook portion 501 at the head of the shelving board 5, and the head hook portion 501 is a semi-enclosed structure. When the shelving board 5 is being installed, the head extension 43 may be received inside the head hook portion 501, that is, the head extension 43 is hooked by the head hook portion 501, and then the shelving board 5 is placed on the rack 4, such that the lower surface of the board body 502 is brought into contact with the upper surface of the rack 4. The head hook portion 501 realizes position-limiting of the shelving board 5 and the rack 4 at the head, so that the shelving board 5 cannot move toward the tail relative to the rack 4. At the same time, as long as the shelving board 5 does not move toward the head relative to the rack 4 to make the head extension 43 disengaged from the head hook portion 501, under the action of the second baffle 57, the shelving board 5 is also unable to move relative to the rack 4 in a vertical direction.

Figure 3:
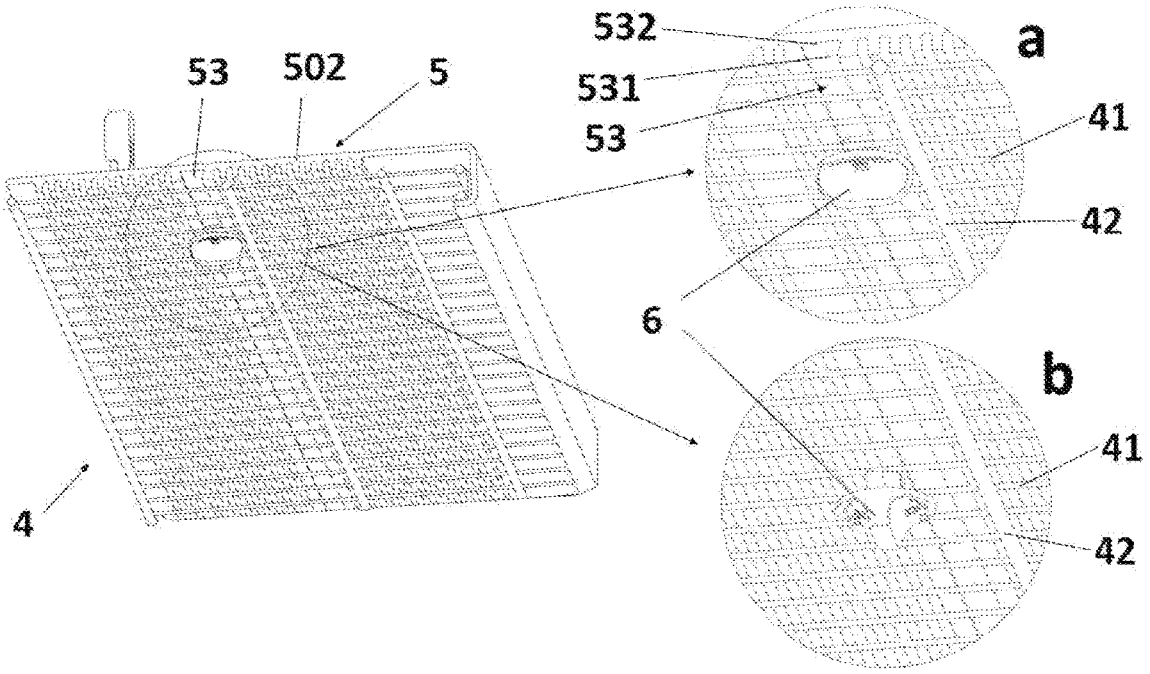
FIG. 3 is a schematic bottom view of Embodiment 1 of the present application.

In order to prevent the shelving board 5 from moving toward the head relative to the rack 4, this embodiment adopts a manner in which a connecting piece cooperates with a matching groove. In this embodiment, a position-limiting knob 6 is used as the connecting piece. As shown in FIG. 3, the lower surface of the board body 502 is also provided with a matching groove 53, which cooperates with the position-limiting knob 6 to realize relative position-limiting between the shelving board 5 and the rack 4 in another position other than the head position. The matching groove 53 is provided parallel to the recessed groove 52 so as to cross the entire shelving board 5 along the transverse direction. The matching groove 53 provided in this embodiment is set to have a trapezoidal section, and comprises a notch 531 and a groove bottom 532. The width of the notch 531 is the short side of the trapezoid, and the width of the groove bottom 532 is the long side of the trapezoid.

Figure 4:
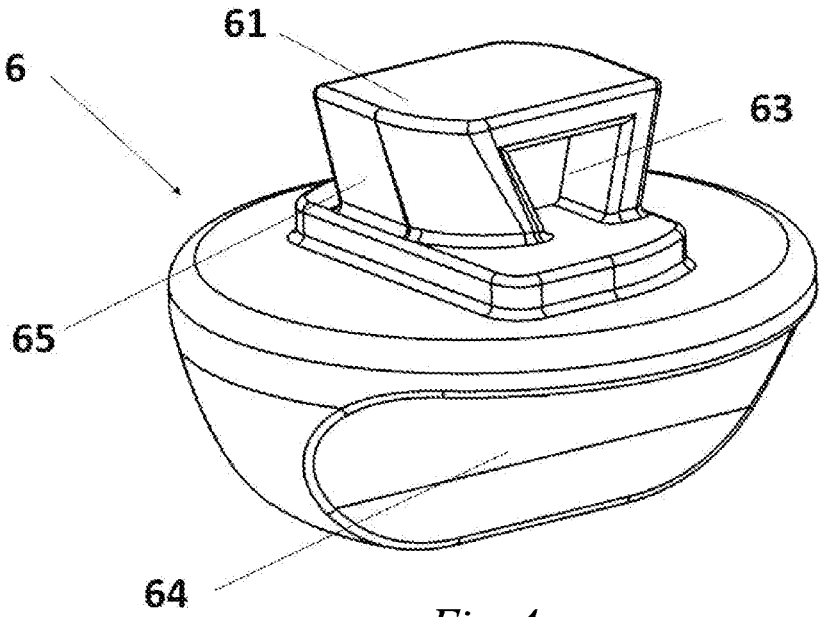
FIG. 4 is a schematic structural view of a position-limiting piece used in Embodiment 1 of the present application.

The specific structure of the position-limiting knob 6 used in this embodiment is shown in FIG. 4, and the overall shape is a knob. The position-limiting knob 6 comprises a rotating portion 64 and a position-limiting matching portion 61. The rotating portion 64 is fixedly connected to the position-limiting matching portion 61. When the rotating portion 64 is rotated by an external force, the position-limiting matching portion 61 is driven and rotates in the same direction. The position-limiting matching portion 61 used in this embodiment is in a shape of a boss, and its area near the rotating portion 64 is less than the area away from the rotating portion 64. In a placement state as shown in the figure of this embodiment, the position-limiting matching portion 61 is in the shape of a boss with a larger upper portion and a smaller lower portion. The position-limiting matching portion 61 has a first side surface 63 and a second side surface 65. The maximum width of the first side surface 63 is less than or equal to the width of the groove bottom 532, and the maximum width of the first side surface 63 is greater than the width of the notch 531. As a result, when the first side surface 63 is set to be perpendicular to the length direction of the matching groove 53, the position-limiting matching portion 61 is stuck inside the matching groove 53, and the position-limiting knob 6 cannot be disengaged from the matching groove 63. Preferably, the first side surface 63 is a trapezoid, and the shape and size of the trapezoid are substantially the same as those of the trapezoid in which the section of the matching groove 53 is located. The maximum width of the second side surface 65 is less than the width of the notch 531. The maximum width of the second side surface 65 is also less than the spacing between adjacent longitudinal metal wires 41. As a result, when the second side surface 65 is set to be perpendicular to the length direction of the matching groove 53, the position-limiting matching portion 61 can freely enter or exit the matching groove 53. The rotating portion 61 used in this embodiment is in a shape of a knob, and its size in the horizontal direction is significantly greater than the spacing between adjacent longitudinal metal wires 41. When the position-limiting knob 6 is being installed, firstly the shelving board 5 is placed on the upper surface of the rack 4, and the second side surface 65 of the position-limiting knob 6 is set to be perpendicular to the length direction of the matching groove 53 (a posture as shown in part b in FIG. 3), so that the position-limiting matching portion 61 can pass through a gap between two longitudinal metal wires 41 from bottom to top, and enter the interior of the matching groove 53. At this time, the rotating portion 61 is rotated to drive the position-limiting matching portion 61 to rotate, such that the first side surface 63 rotates to a position perpendicular to the length direction of the matching groove 53 (a posture as shown in part a in FIG. 3). At this time, the position-limiting matching portion 61 is stuck in the matching groove 53, so the shelving board 5 and the position-limiting knob 6 are relatively fixed. Since the horizontal size of the rotating portion 64 is significantly greater than the spacing between the longitudinal metal wires 41, its position is maintained under the rack 4. This makes it impossible for the shelving board 5 to move relative to the rack 4 in the vertical direction. As shown in FIG. 3, the matching groove 53 is provided near the position of a transverse metal wire 42 and in the tail direction of the transverse metal wire 42. When the position-limiting knob 6 is engaged into the matching groove 53, the rotating portion 64 comes into contact with the metal wire 42. When the shelving board 5 has a tendency to move toward the head relative to the rack 4, since the position-limiting knob 6 is blocked by the transverse metal wire 42, the shelving board 5 cannot move toward the head relative to the rack 4.

In other similar embodiments, the position-limiting knob 6 may also have a similar structure, as long as restriction of a movement of the shelving board 5 relative to the rack 4 in the vertical direction and restriction of a movement of the shelving board 5 toward the head relative to the rack 4 are realized.

Under the joint action of the head hook portion 501 and the position-limiting knob 6, the connection between the shelving board 5 and the rack 4 is realized, which hinders possible relative movements of the shelving board 5 relative to the rack 4 in various directions, thereby forming a stable shelving assembly comprising the shelving board 5 and the rack 4.

Embodiment 2

The structure of a shelving board 5 provided in this embodiment and the connection relationship between the shelving board 5 and a rack 4 are substantially the same as those in Embodiment 1, and the same parts will not be repeated here.

Figure 5:
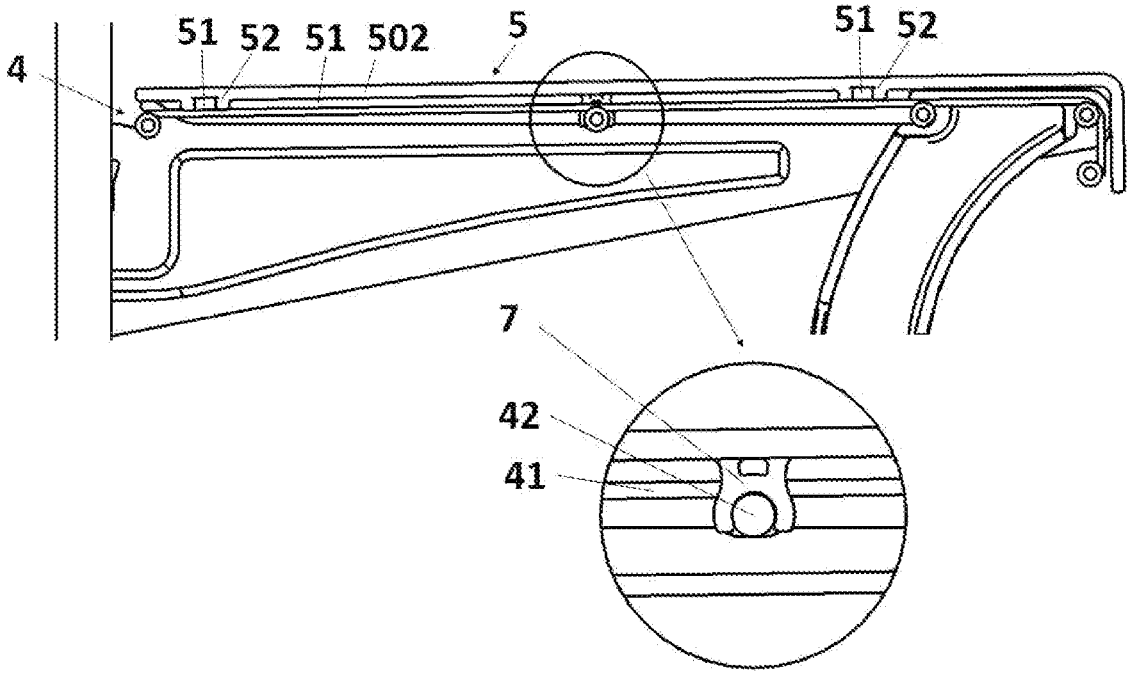
FIG. 5 is a schematic side cross-sectional view of Embodiment 2 of the present application.
Figure 6:
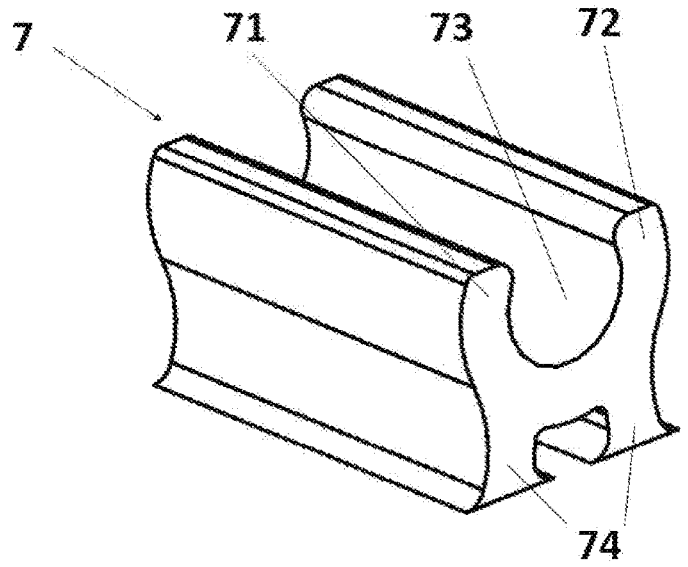
FIG. 6 is a schematic structural view of a position-limiting piece used in Embodiment 2 of the present application.

As shown in FIGS. 5-6, the lower surface of a board body 502 of this embodiment is provided with four raised bands 52, and the four raised bands 52 are all provided in parallel along the transverse direction. The heights and widths of the four raised bands 52 are all the same, such that the lower surfaces of the four raised bands 52 are still kept in the same plane. Two of the raised bands 52 are provided near the head, and the other two raised bands 52 are provided near the tail. Recessed grooves 51 are formed between all adjacent raised bands 52. Therefore, a total of three recessed grooves 51 are formed between the four raised bands 52 in this embodiment. The widths of the recessed groove 51 near the head and the recessed groove 51 near the tail are less than the width of the recessed groove 51 in the middle position. As shown in FIG. 5, the recessed groove 51 in the middle position covers most of the area of the board body 502, so that the material used for the shelving board 5 is further reduced and the manufacturing cost is reduced.

In Embodiment 1, using the position-limiting knob 6 separated from the board body 502 for fixing is reliable, but the structure is complicated. Therefore, in this embodiment, a relatively simple position-limiting protrusion 7 is used to achieve a technical effect similar to that of the position-limiting knob 6 in Embodiment 1.

The position-limiting protrusion 7 is made of an elastic material, preferably, the same material as the board body 502. The specific structure of the position-limiting protrusion 7 in this embodiment is shown in FIG. 6, which comprises a first petal 71, a second petal 72 and a base 74. The first petal 71 and the second petal 72 are both arc-shaped and oppositely provided. The two petals are close to each other at end portions and form a substantially circular or semi-circular receiving space 73 near the base 74 for receiving a transverse metal wire 42. The spacing between the end portions of the first petal 71 and the second petal 72 is slightly less than the diameter of the transverse metal wire 42. The base 74 is used to be connected to the board body 502. The position-limiting protrusion 7 may be processed and formed individually, and fixedly connected to the board body 502 by means of adhesion, screws, etc., or may be integrally processed and formed with the board body 502.

In this embodiment, the position-limiting protrusion 7 is provided on the lower surface of the board body 502 at a position corresponding to the transverse metal wire 42. A plurality of position-limiting protrusions 7 may be provided at positions corresponding to the same transverse metal wire 42, or a plurality of position-limiting protrusions 7 may also be provided at the same time at positions corresponding to a plurality of transverse metal wires 42 on the rack 4. When the shelving board 5 is being installed, the board body 502 is pressed toward the rack 4, and the two petals of the position-limiting protrusion 7 are slightly separated due to elasticity under the action of the transverse metal wire 42, thus wrapping the transverse metal wire 42 in the receiving space, and exerting pretension forces in various directions on the transverse metal wire 42, so as to play a role of position-limiting and connecting. Specifically, the first petal 71 exerts a force on the transverse metal wire 42 toward the head; and the second petal 72 exerts a force on the transverse metal wire 42 toward the tail. It can be understood that although the two-petal position-limiting protrusion 7 can play a good position-limiting and connecting role, the first petal 71 and the second petal 72 respectively exert a certain degree of force on the metal wire 42. Therefore, the first petal 71 and the second petal 72 do not need to exist at the same time. In some embodiments, for example, when only any one of the two petals is processed, or only one of the two petals exists due to damage, the position-limiting protrusion 7 can still play the role of position-limiting and connecting to a certain degree.

Embodiment 3

The structure of a shelving board 5 provided in this embodiment and the connection relationship between the shelving board 5 and a rack 4 are substantially the same as those in foregoing Embodiments, and the same parts will not be repeated here.

Figure 7:
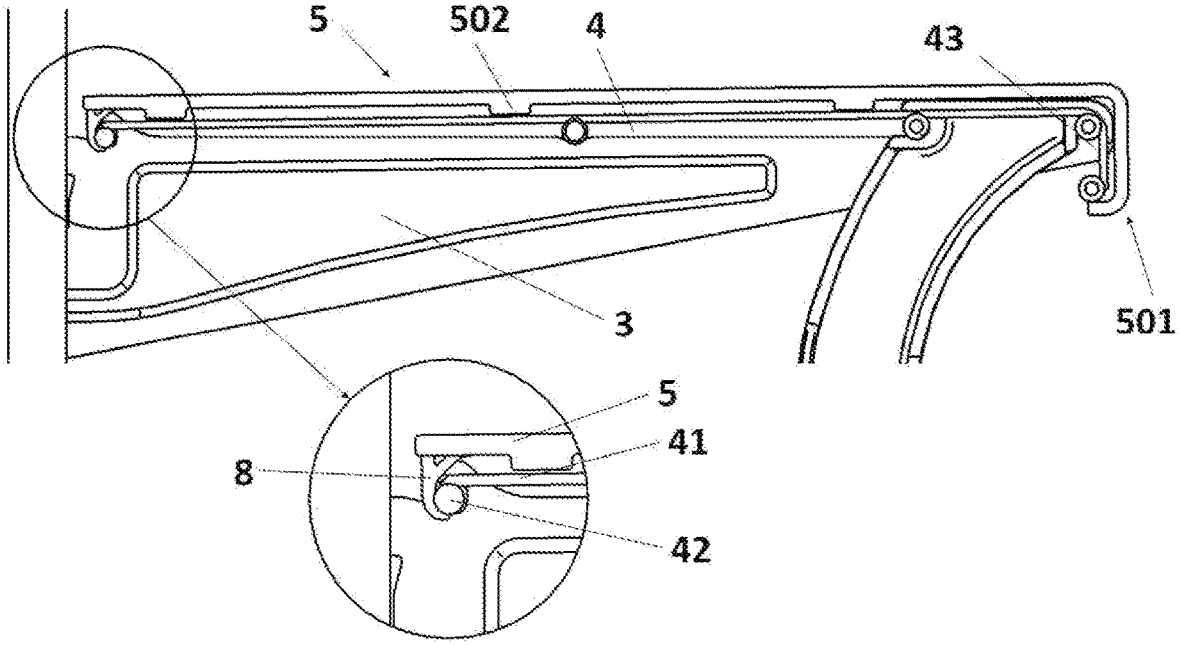
FIG. 7 is a schematic side cross-sectional view of Embodiment 3 of the present application.
Figure 8:
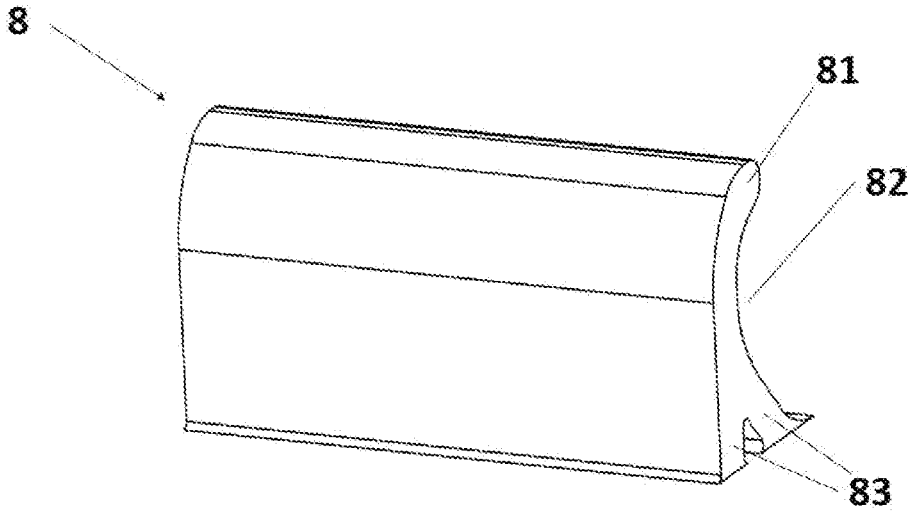
FIG. 8 is a schematic structural view of a position-limiting piece used in Embodiment 3 of the present application.

As shown in FIGS. 7-8, a board body 502 in this embodiment is provided with a position-limiting hook 8 at the tail. The position-limiting hook 8 is made of an elastic material, preferably, the same material as the board body 502. The specific structure of the position-limiting hook 8 is shown in FIG. 8, which comprises a hook end 81, a hook bend 82 and a base 83. The position-limiting hook 8 is arc-shaped as a whole, its end 81 faces the head, and its base 83 is used to be connected to the board body 502. The position-limiting hook 8 may be processed and formed individually, and fixedly connected to the board body 502 by means of adhesion, screws, etc., or may be processed and formed integrally with the board body 502. The position-limiting hook 8 is provided on the lower surface of the board body 502 at a position corresponding to the transverse metal wire 42 closest to the tail of the rack 4. When the shelving board 5 is being installed, the head extension 43 is received in the head hook portion 501 (as described in Embodiment 1), and at the same time, the position-limiting hook 8 is used to hook the transverse metal wire 42 located at the tail. The head hook portion 501 exerts a force on the rack 4 toward the tail, and the position-limiting hook 8 exerts a force on the rack 4 toward the head, thereby realizing position-limiting and connecting between the shelving board 5 and the rack 4.

Embodiment 4

The structure of a shelving board 5 provided in this embodiment and the connection relationship between the shelving board 5 and a rack 4 are substantially the same as those in foregoing Embodiments, and the same parts will not be repeated here.

Figure 9:
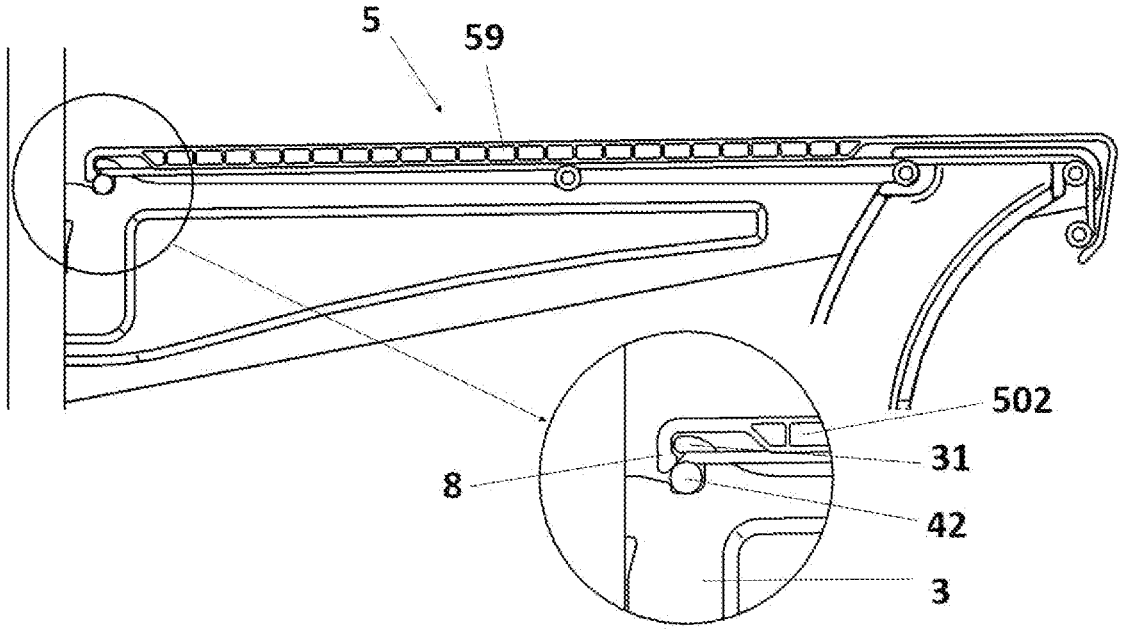
FIG. 9 is a schematic side cross-sectional view of Embodiment 4 of the present application.

As shown in FIG. 9, a board body 502 in this embodiment is provided to be hollow and sheet-like. It can be seen from the side cross-sectional view shown in FIG. 9 that a plurality of hollow channels 59 are provided in the interior of the board body 502. Preferably, these hollow channels 59 are provided parallel to each other, and are all provided along the transverse direction and cross the entire shelving board 5. Each hollow channel 59 has the same width and height, and the spacing between adjacent hollow channels 59 is also the same. In other similar embodiments, the plurality of hollow channels 59 may also be provided with different shapes and sizes, and the spacing between adjacent hollow channels 59 may not be completely the same.

In this embodiment, the position-limiting hook 8 is an arc-shaped hook portion extending downward from the tail of the board body. The bracket 3 comprises a raised rib 31, which is a raised part extending from the tail of the bracket 3, and points toward the tail. The raised rib 31 forms a semi-enclosed structure for receiving a transverse metal wires 42 of the rack 4 so that the rack 4 is fixed relative to the bracket 3. When the shelving board 5 is being installed, the position-limiting hook 8 is brought into contact with the raised rib 31 and is stuck into the semi-enclosed structure formed by the raised rib 31. In this way, the position-limiting and connecting between the shelving board 5 and the bracket 3 are realized.

Embodiment 5

Figure 10:
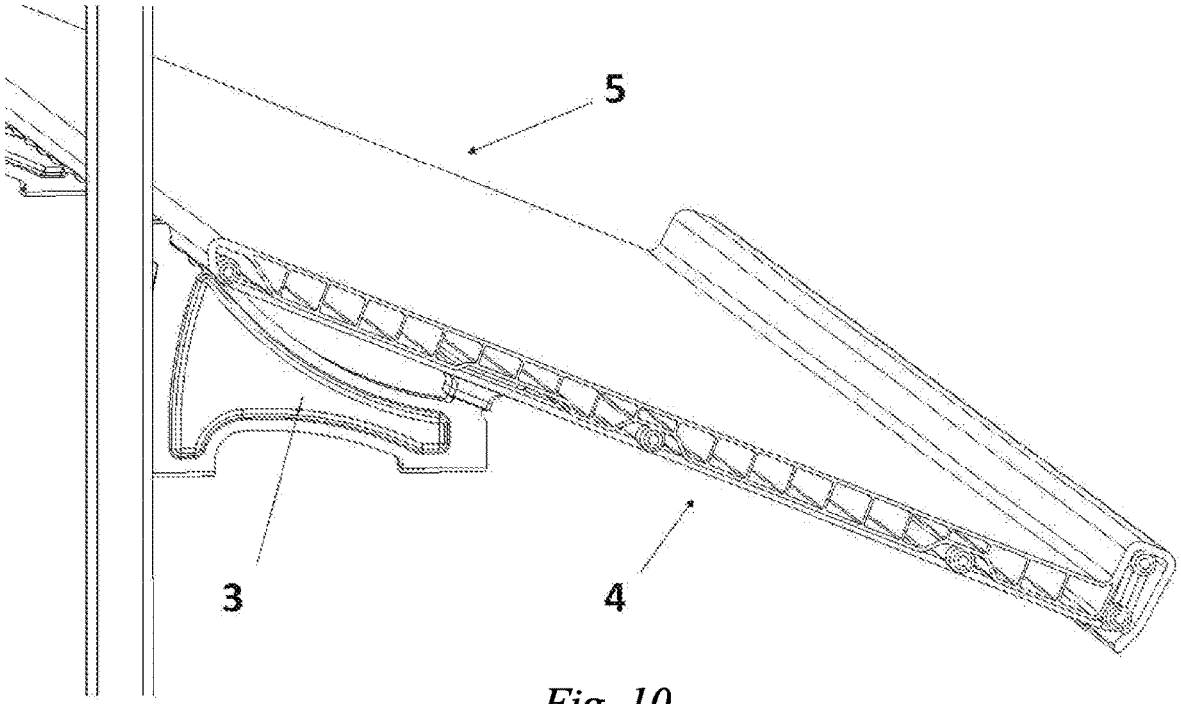
FIG. 10 is a schematic view of the overall structure in Embodiment 5 of the present application.
Figure 11:
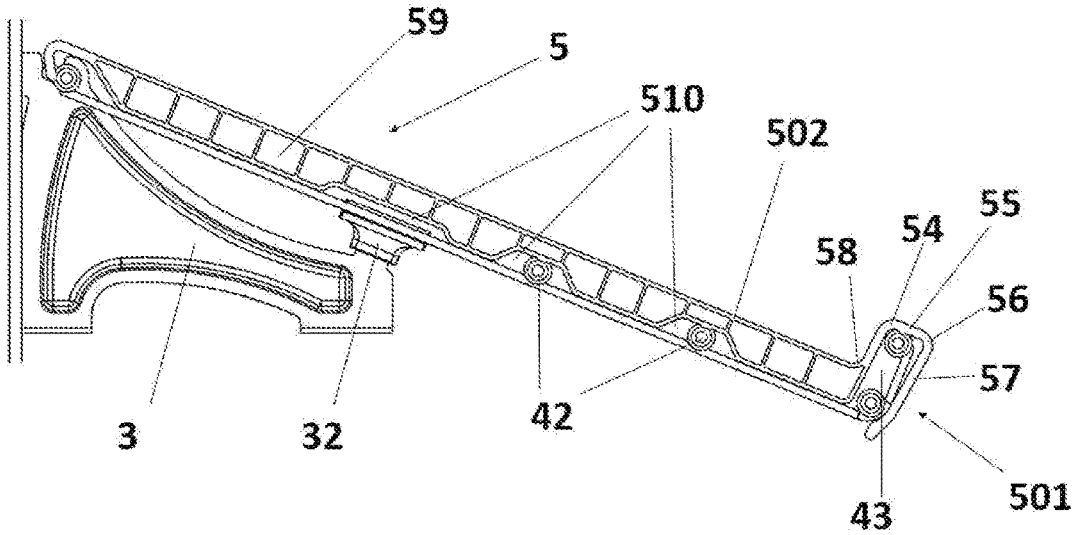
FIG. 11 is a schematic side cross-sectional view of Embodiment 5 of the present application.

In some shelving systems, especially when the shelf is used as a shoe shelf, it is usually necessary to place a rack in a tilted manner, as shown in FIGS. 10-11. In order to prevent goods from slipping off, a conventional method is to turn the rack 4 upside down for use. At this time, the transverse metal wire 42 is above the longitudinal metal wire 41. Since the diameter of the transverse metal wire 42 is greater than that of the longitudinal metal wire 41, and the spacing between adjacent transverse metal wires 42 is greater than the spacing between adjacent longitudinal metal wires 41, the upper surface of the rack 4 is extremely uneven. Therefore, a plurality of avoiding grooves 510 are provided on the lower surface of the shelving board 5 provided in this embodiment. The avoiding grooves 510 are provided at all corresponding positions where the upper surface of the racks 4 are raised, which causes the surface of the rack 4 to be uneven, so as to avoid interference. In this embodiment, preferably as shown in FIG. 11, the avoiding grooves 510 are provided at corresponding positions where the transverse metal wires 42 are located and a corresponding position where a bracket connecting piece 32 is located. The plurality of avoiding grooves 510 may have the same depth and width, and the depth and width may also be adjusted according to an actual need. The avoiding grooves 510 may cross the board body 502, or may have other length sizes, as long as it can be ensured that interference between the shelving board 5 and the raised parts on the upper surface of the rack 4 is prevented.

Since the rack 4 is turned upside down for use, its head extension 43 is upwardly warped. In order to cooperate with the head extension 43, the shelving board 5 provided in this embodiment is provided with three bent portions 58, 54, 56 at the head. In the viewing angle of FIG. 11, the bent portion 58 is bent counter-clockwisely, and the bent portion 54 and the bent portion 56 are bent clockwisely. The first baffle 55 is connected to the board body 502 through the bent portion 58 and the bent portion 54, and the second baffle is connected to the first baffle 55 through the bent portion 56. The bent portions 58, 54, 56 and the baffles 55, 57 together form a head hook portion 501. Preferably, the baffle 55 is provided parallel to the board body 502, and the baffle 57 is provided perpendicular to the board body 502. As a result, the head hook portion 501 and the head extension 43 have substantially the same cross-sectional shape, and the head extension 43 is wrapped inside the head hook portion 501. Therefore, the position-limiting and connecting between the shelving board 5 and the rack 4 is realized.

It should be understood that technical features such as the head hook portion 501, the recessed groove 51 and the raised band 52, the matching groove 53 and the position-limiting knob 6, the position-limiting protrusion 7, the position-limiting hook 8, the avoiding groove 510, and the hollow channel 59 described in the above embodiments do not exist by depending on each other. Those skilled in the art may combine one or more of the above technical features to form similar technical solutions according to actual needs, all of which are within the scope of this specification.

The shelving boards 5 provided in the above embodiments may all be made by an extrusion process. The shelving board 5 manufactured by the extrusion process can be cut into an appropriate length according to an actual need, and there is no need to prepare a plurality of sizes of prefabricated molds for racks 4 of different lengths, which can greatly reduce the cost.

Figure 12:
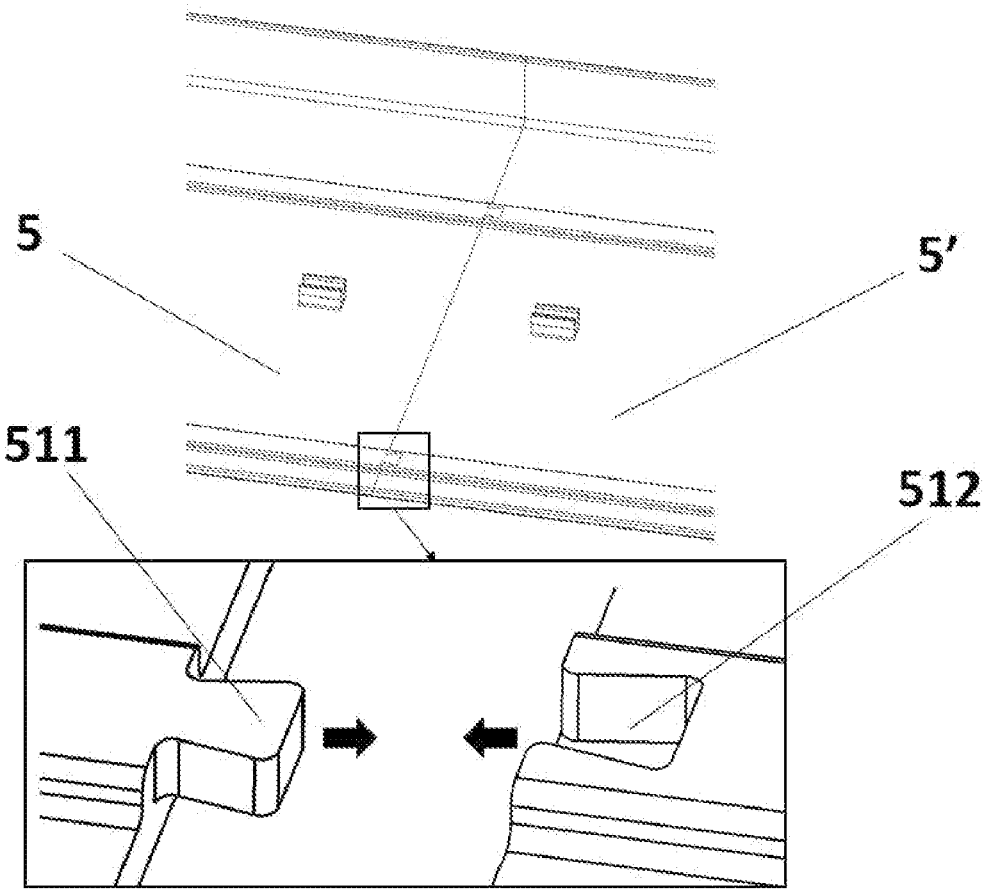
FIG. 12 is a schematic view of a splicing relationship in an embodiment of the present application.

The shelving boards 5 provided in the above embodiments may all be made into prefabricated pieces of the same size by an injection molding process. In some shelving assemblies, in order to be suitable for racks 4 of different lengths, a plurality of shelving boards 5 may be spliced, by means of a splicing mechanism, for use. The splicing mechanism in this embodiment is shown in FIG. 12, one end of the board body 502 of the shelving board 5 is provided with a splicing protrusion 511, and the other end of the board body 502, that is, an end away from the splicing protrusion 511, is provided with a splicing recess 512. The splicing protrusion 511 and the splicing recess 512 have matching shapes and sizes. Preferably, the splicing protrusion 511 and the splicing recess 512 may be set as trapezoids. The splicing protrusion 511 and the splicing recess 512 of the two shelving boards 5, 5' are engaged in the direction shown in FIG. 12 to realize the splicing and relative position-limiting between the two shelving boards 5, 5'.

The preferred embodiments of the present application are described in detail above. It should be understood that those of ordinary skills in the art may make many modifications and changes according to the concept of the present application without creative work. Therefore, all technical solutions that can be obtained by those skilled in the art through logical analysis, reasoning or limited experiments based on the concept of the present application and the prior art should fall within the scope of protection defined by the claims.

The invention claimed is:

1. A shelving board, comprising a board body and a connecting piece, wherein the connecting piece is connected to the board body, and the connecting piece is configured to be connected to a bracket or a rack so as to hinder a relative movement of the board body relative to the bracket;

wherein the board body comprises a first surface and a second surface, the first surface is in contact with a surface of the rack, and the second surface is used to carry items;

wherein the connecting piece is detachably connected to the first surface of the board body;

wherein a matching groove is provided on the first surface, the connecting piece comprises a matching portion and a rotating portion, and the rotating portion drives the matching portion to rotate in the same direction when the rotating portion rotates;

wherein the matching portion is configured to be first placed inside the matching groove and then rotated to realize a connection between the connecting piece and the board body.

2. The shelving board of claim 1, wherein the width of a groove bottom of the matching groove is greater than the width of a notch of the matching groove.

3. The shelving board of claim 2, wherein the matching portion has a first side surface, the maximum width of the first side surface is less than or equal to the width of the groove bottom, and the maximum width of the first side surface is greater than the width of the notch.

4. The shelving board of claim 3, wherein the matching portion has a second side surface, and the maximum width of the second side surface is less than the width of the notch.

5. The shelving board of claim 4, wherein the connecting piece has a first posture, and in the first posture, the first side surface is set to be perpendicular to the length direction of the matching groove, such that the matching portion is engaged into the matching groove.

6. The shelving board of claim 5, wherein the connecting piece has a second posture, and in the second posture, the second side surface is set to be perpendicular to the length direction of the matching groove, such that the matching portion can enter or exit the matching groove.

7. A shelving board comprising a board body and a connecting piece, wherein the connecting piece is connected to the board body, and the connecting piece is configured to be connected to a bracket or a rack so as to hinder a relative movement of the board body relative to the bracket;

wherein the board body comprises a first surface and a second surface, the first surface is in contact with a surface of the rack, and the second surface is used to carry items;

wherein the connecting piece is located beneath the first surface of the board body and fixedly connected to the first surface of the board body;

wherein the connecting piece comprises a position-limiting protrusion, and the position-limiting protrusion is configured to receive a transverse metal wire at any position of the bracket.

8. The shelving board of claim 7, wherein the position-limiting protrusion comprises a first petal, and the first petal is configured to impart a force on the transverse metal wire toward a head.

9. The shelving board of claim 8, wherein the position-limiting protrusion comprises a second petal, and the second petal is configured to impart a force on the transverse metal wire toward a tail.

10. The shelving board of claim 9, wherein the first petal and the second petal are arc-shaped, and the first petal and the second petal are oppositely provided, such that a receiving space is formed between the first petal and the second petal.

11. The shelving board of claim 9, wherein a spacing between an end portion of the first petal and an end portion of the second petal is less than a diameter of the transverse metal wire.

12. A shelving board comprising a board body and connecting pieces, wherein the connecting pieces are configured to be connected to a bracket or a rack so as to hinder a relative movement of the board body relative to the bracket;

wherein the connecting pieces comprise a head hook portion which is provided at a head of the board body, and the head hook portion is a semi-enclosed structure extending from the head of the board body;

wherein the connecting pieces comprise a position-limiting hook which is provided at a tail of the board body, and the position-limiting hook is an arc-shaped hook portion extending downward from the tail of the board body;

wherein the connecting pieces are fixedly connected to the board body or are processed and formed integrally with the board body.

13. The shelving board of claim 12, wherein the head hook portion comprises a first bent portion and a first baffle, and the first baffle is connected to the board body through the first bent portion.

14. The shelving board of claim 13, wherein the head hook portion comprises a second bent portion and a second baffle, and the second baffle is connected to the first bent portion through the second bent portion and the first baffle.

15. The shelving board of claim 12, wherein the position-limiting hook is configured to be engaged with a raised rib on the bracket.

16. The shelving board of claim 1, wherein the first surface is configured to have a recessed-and-raised structure.

17. The shelving board of claim 16, wherein the recessed-and-raised structure comprises recessed grooves and raised bands, and the recessed grooves and the raised bands are alternately provided.

18. The shelving board of claim 17, wherein the recessed grooves are provided parallel to each other.

19. The shelving board of claim 1, wherein a hollow channel is provided in the interior of the board body.

20. The shelving board of claim 1, wherein the board body comprises a splicing protrusion, and the splicing protrusion is provided at an end of the board body.

21. A shelving assembly, comprising at least two shelving boards, wherein the at least two shelving boards are spliced by means of a splicing mechanism;

wherein the shelving board comprises a board body and a connecting piece, wherein the connecting piece is connected to the board body, and the connecting piece is configured to be connected to a bracket or a rack so as to hinder a relative movement of the board body relative to the bracket;

wherein the board body comprises a first surface and a second surface, the first surface is in contact with a surface of the rack, and the second surface is used to carry items;

wherein the connecting piece is detachably connected to the first surface of the board body;

wherein a matching groove is provided on the first surface, the connecting piece comprises a matching portion and a rotating portion, and the rotating portion drives the matching portion to rotate in the same direction when the rotating portion rotates;

wherein the matching portion is configured to be first placed inside the matching groove and then rotated to realize a connection between the connecting piece and the board body.

22. The shelving assembly of claim 21, wherein the splicing mechanism comprises a splicing protrusion, and the splicing protrusion is provided at an end of the shelving board.

23. The shelving assembly of claim 22, wherein the splicing mechanism comprises a splicing recess, and the splicing recess is provided at an end of the shelving board away from the splicing protrusion.

24. The shelving assembly of claim 23, wherein the splicing protrusion and the splicing recess have matching shapes and sizes.

25. The shelving assembly of claim 24, wherein the splicing protrusion and the splicing recess are engaged with each other to realize splicing of the shelving boards.

26. A shelving assembly, comprising a shelving board, a rack, a bracket, a vertical beam, and a horizontal beam, wherein the horizontal beam is configured to be connected to a vertical surface, the vertical beam is connected to the horizontal beam, the bracket is connected to the vertical beam, the rack is connected to the bracket, and the shelving board is connected to the bracket;

wherein the shelving board comprises a board body and a connecting piece, wherein the connecting piece is connected to the board body, and the connecting piece is configured to be connected to a bracket or a rack so as to hinder a relative movement of the board body relative to the bracket;

wherein the board body comprises a first surface and a second surface, the first surface is in contact with a surface of the rack, and the second surface is used to carry items;

wherein the connecting piece is detachably connected to the first surface of the board body;

wherein a matching groove is provided on the first surface, the connecting piece comprises a matching portion and a rotating portion, and the rotating portion drives the matching portion to rotate in the same direction when the rotating portion rotates;

wherein the matching portion is configured to be first placed inside the matching groove and then rotated to realize a connection between the connecting piece and the board body.

* * * * *